US009926061B2

(12) United States Patent
Mizutani

(10) Patent No.: US 9,926,061 B2
(45) Date of Patent: Mar. 27, 2018

(54) OUTBOARD MOTOR AND OUTBOARD MOTOR MOVEMENT MECHANISM

(71) Applicant: YAMAHA HATSUDOKI KABUSHIKI KAISHA, Iwata-shi, Shizuoka (JP)

(72) Inventor: Makoto Mizutani, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/398,742

(22) Filed: Jan. 5, 2017

(65) Prior Publication Data

US 2017/0355432 A1 Dec. 14, 2017

(30) Foreign Application Priority Data

Jun. 14, 2016 (JP) ..... 2016-117599

(51) Int. Cl.
*B63H 20/10* (2006.01)
*B63H 20/06* (2006.01)
*B63H 23/30* (2006.01)

(52) U.S. Cl.
CPC ..... *B63H 20/106* (2013.01); *B63H 20/06* (2013.01); *B63H 23/30* (2013.01)

(58) Field of Classification Search
CPC ..... B63H 20/06; B63H 20/08; B63H 20/10; B63H 21/21; B63H 21/26; B63H 20/106; B63H 23/30
USPC ..... 114/285, 286; 440/61 R, 61 T, 63
See application file for complete search history.

(56) References Cited

U.S. PATENT DOCUMENTS 4,354,848 A * 10/1982 Hall ..... B63H 21/26 440/61 R
4,673,358 A 6/1987 Iwai et al.
4,682,961 A * 7/1987 Nakahama ..... B63H 20/10 440/63
4,781,631 A * 11/1988 Uchida ..... B63H 21/26 440/61 R
4,813,897 A * 3/1989 Newman ..... B63H 20/06 440/61 R
4,836,811 A * 6/1989 Griffiths ..... B63H 20/06 440/61 R
4,842,559 A * 6/1989 Litjens ..... B63H 21/265 440/61 R
4,861,292 A * 8/1989 Griffiths ..... B63H 20/10 440/61 R
4,872,859 A * 10/1989 Griffiths ..... B63H 20/06 440/53

(Continued)

FOREIGN PATENT DOCUMENTS

JP 60-248493 A 12/1985

*Primary Examiner* — Lars A Olson
(74) *Attorney, Agent, or Firm* — Keating and Bennett, LLP

(57) ABSTRACT

An outboard motor includes an outboard motor body, a first support mounted on a boat body, a second support that rotatably supports the outboard motor body, a linkage that couples the first support and the second support to each other such that the second support is movable in a vertical direction and rotatable with respect to the first support, a first drive that rotates the second support coupled to the first support through the linkage with respect to the first support while moving the second support in the vertical direction with respect to the first support, and a second drive that rotates the outboard motor body with respect to the second support.

15 Claims, 8 Drawing Sheets

(56) References Cited

U.S. PATENT DOCUMENTS

| | | | | | |
|---|---|---|---|---|---|
| 4,931,027 | A | * | 6/1990 | Nakahama | B63H 20/10<br>440/63 |
| 5,169,350 | A | * | 12/1992 | Tsujii | B63H 20/10<br>440/61 R |

* cited by examiner

OUTBOARD MOTOR AND OUTBOARD MOTOR MOVEMENT MECHANISM

CROSS-REFERENCE TO RELATED APPLICATION

This application claims priority to Patent Application No. 2016-117599 filed in Japan on Jun. 14, 2016, the entire contents of which are hereby incorporated herein by reference.

BACKGROUND OF THE INVENTION

1. Field of the Invention

The present invention relates to an outboard motor and an outboard motor movement mechanism.

2. Description of the Related Art

An outboard motor is known in general. Such an outboard motor is disclosed in Japanese Patent Laid-Open No. 60-248493, for example.

Japanese Patent Laid-Open No. 60-248493 discloses an outboard motor including an outboard motor body, a bracket mounted on a boat body, first and second links that couple the bracket and the outboard motor body to each other, a lift cylinder mechanism, and a tilt cylinder mechanism. In the outboard motor described in Japanese Patent Laid-Open No. 60-248493, the lift cylinder mechanism adjusts the angle of the outboard motor body when a boat is moving, and the tilt cylinder mechanism adjusts the storage attitude of the outboard motor body when the boat is stored.

In another conventional outboard motor, a mechanism that moves an outboard motor body in a vertical direction is further provided, and a technology to adjust the position of the outboard motor body in the vertical direction in addition to the angle of the outboard motor body when a boat is moving is known.

In the conventional outboard motor, the mechanism that adjusts the angle of the outboard motor body and the mechanism that adjusts the position of the outboard motor body in the vertical direction separately operate to adjust the position and attitude of the outboard motor body when the boat is moving, and hence the operation load is increased. Thus, an outboard motor and an outboard motor movement mechanism that significantly reduce an increase in the operation load to adjust the position and attitude of the outboard motor body when the boat is moving are desired.

SUMMARY OF THE INVENTION

Preferred embodiments of the present invention provide an outboard motor and an outboard motor movement mechanism that significantly reduce or prevent an increase in the operation load to adjust the position and attitude of an outboard motor body when a boat is moving.

An outboard motor according to a preferred embodiment of the present invention includes an outboard motor body, a first support mounted on a boat body, a second support that rotatably supports the outboard motor body, a linkage that couples the first support and the second support to each other such that the second support is movable in a vertical direction and rotatable with respect to the first support, a first drive that rotates the second support coupled to the first support through the linkage with respect to the first support while moving the second support in the vertical direction with respect to the first support, and a second drive that rotates the outboard motor body with respect to the second support.

An outboard motor according to a preferred embodiment of the present invention includes the second support that rotatably supports the outboard motor body, the linkage that couples the first support and the second support to each other such that the second support is movable in the vertical direction and rotatable with respect to the first support, and the first drive that rotates the second support coupled to the first support through the linkage with respect to the first support while moving the second support in the vertical direction with respect to the first support. Thus, the first drive is driven such that the position of the outboard motor body in the vertical direction is adjusted simultaneously while the angle (trim angle) of the outboard motor body supported by the second support is adjusted. Consequently, it is not necessary to separately manipulate the angle of the outboard motor body and the position of the outboard motor body in the vertical direction when the boat is moving, and hence an increase in the operation load to adjust the position and attitude of the outboard motor body when the boat is moving is significantly reduced or prevented. The first drive is driven such that the outboard motor body is rotated and moved in the vertical direction, and hence the structure of the outboard motor is simplified as compared with the case where a mechanism that rotates the outboard motor body and a mechanism that moves the outboard motor body in the vertical direction are provided separately. Furthermore, the outboard motor includes the second drive that rotates the outboard motor body with respect to the second support such that the outboard motor body, which has been moved in the vertical direction and rotated by the first drive, is further rotated by the second drive, and the tilt angle is adjusted. Thus, the outboard motor body is easily moved to an attitude to be assumed when the boat is stored. The outboard motor body is moved and rotated by the first drive, and hence the driving range of the second drive is reduced. Thus, an increase in the size of the second drive is significantly reduced or prevented.

In an outboard motor according to a preferred embodiment of the present invention, the linkage preferably includes a first coupler that couples an upper portion of the first support and an upper portion of the second support to each other and a second coupler that couples a lower portion of the first support and a lower portion of the second support to each other. Accordingly, the first support and the second support are coupled to each other by the first coupler and the second coupler that are vertically separated from each other, and hence the second support is moved with respect to the first support by the first drive such that the angle of the outboard motor body is easily changed, and the vertical position of the outboard motor body is moved.

In this case, a coupling distance that is a length of the first coupler between the first support and the second support is preferably shorter than a coupling distance that is a length of the second coupler between the first support and the second support. Accordingly, the lower coupling distance is longer than the upper coupling distance, and hence the outboard motor body is moved upward while the angle of the outboard motor body is changed.

In the structure of the linkage, the coupling distance of the first coupler is shorter than the coupling distance of the second coupler, and the coupling distance of the first coupler and the coupling distance of the second coupler are preferably adjustable. Accordingly, the distance that the outboard motor body moves in the vertical direction associated with the rotation of the outboard motor body is adjustable, and hence the linkage is adjusted such that the outboard motor body assumes an appropriate attitude according to the output of the outboard motor and the size of the boat body.

An outboard motor according to a preferred embodiment of the present invention preferably further includes a rotation shaft that supports the outboard motor body such that the outboard motor body is rotatable with respect to the second support, and the first drive preferably moves the rotation shaft together with the second support with respect to the first support. Accordingly, the rotation shaft is moved upward when the second support is moved upward and rotated by the first drive, and hence the rotation angle of the outboard motor body with respect to the second support is reduced. Consequently, any projection of an upper portion of the outboard motor body toward the boat body is reduced when the outboard motor body is rotated upward.

In this case, the rotation shaft is preferably arranged above an upper end of the first support when the outboard motor body is rotated with respect to the second support. Accordingly, the rotation angle of the outboard motor body with respect to the second support is further reduced when the outboard motor body is rotated upward.

In the structure including the rotation shaft, the rotation shaft is preferably kept stationary with respect to the first support when the outboard motor body is rotated with respect to the second support. Accordingly, the outboard motor body is rotated with respect to the second support in a state where the rotation shaft is fixed, and hence the outboard motor body is rotated in a stable manner.

In an outboard motor according to a preferred embodiment of the present invention, the first drive preferably moves a rotation center of the second support with respect to the first support while moving the second support in the vertical direction with respect to the first support. Accordingly, the position of the outboard motor body in the vertical direction and the rotation angle of the outboard motor body are easily changed simultaneously.

In an outboard motor according to a preferred embodiment of the present invention, the first drive preferably rotates the second support with respect to the first support within a range of a first angle, and the second drive preferably rotates the outboard motor body with respect to the second support within a range of a second angle that is larger than the first angle. Accordingly, the angle (trim angle) of the outboard motor body and the position of the outboard motor body in the vertical direction are adjusted by the first drive when the boat is moving, and the angle (tilt angle) of the outboard motor body is adjusted by the second drive when the boat is stored.

An outboard motor according to a preferred embodiment of the present invention preferably further includes a movement restrictor that prevents rotation of the outboard motor body with respect to the second support. Accordingly, the rotation of the outboard motor body with respect to the second support is prevented when the second support is moved with respect to the first support, and hence complicated movement of the outboard motor body is significantly reduced or prevented. Furthermore, the simultaneous driving of the first drive and the second drive is significantly reduced or prevented, and hence an increase in the total load resulting from duplication of the driving load is significantly reduced or prevented.

In the structure including the movement restrictor, the movement restrictor preferably allows the rotation of the outboard motor body with respect to the second support when a rotation angle or a movement of the second support with respect to the first support is at least a predetermined value. Accordingly, the outboard motor body is moved with respect to the second support in a state where the second support is moved with respect to the first support, and hence the rotation angle of the outboard motor body with respect to the second support is easily reduced.

In this case, the movement restrictor preferably includes an engagement portion that engages with the linkage or the outboard motor body, prevents the rotation of the outboard motor body with respect to the second support by engagement of the engagement portion with the linkage or the outboard motor body, and allows the rotation of the outboard motor body with respect to the second support by disengagement of the engagement portion when the rotation angle or the movement of the second support with respect to the first support is at least the predetermined value. Accordingly, the movement restrictor is mechanically engaged such that the rotation of the outboard motor body with respect to the second support is prevented. Thus, the rotation of the outboard motor body with respect to the second support is more reliably prevented.

In the structure including the movement restrictor, the movement restrictor preferably includes a detector that detects a predetermined rotation angle or a predetermined movement of the second support with respect to the first support, and electrically allows the rotation of the outboard motor body with respect to the second support when the rotation angle or the movement of the second support with respect to the first support is at least a predetermined value. Accordingly, the predetermined rotation angle or the predetermined movement of the second support with respect to the first support is detected by the detector such that the rotation of the outboard motor body with respect to the second support is easily prevented.

In the structure including the movement restrictor, the outboard motor body preferably includes an engine, and the movement restrictor preferably allows the rotation of the outboard motor body with respect to the second support when a rotational speed of the engine is not more than a predetermined value. Accordingly, the possibility that the outboard motor body comes out of the water is significantly reduced or prevented when the engine is driven at a high rotational speed.

In the structure including the movement restrictor, the outboard motor body preferably includes an engine and a gearing that switches a drive force of the engine to forward movement, reverse movement, and neutral, and the movement restrictor preferably allows the rotation of the outboard motor body with respect to the second support when the gearing is in neutral. Accordingly, the possibility that the outboard motor body comes out of the water is significantly reduced or prevented when a propeller is rotated.

An outboard motor movement mechanism according to a preferred embodiment of the present invention includes a first support mounted on a boat body, a second support that rotatably supports an outboard motor body, a linkage that couples the first support and the second support to each other such that the second support is movable in a vertical direction and rotatable with respect to the first support, and a first drive that rotates the second support coupled to the first support through the linkage with respect to the first support while moving the second support in the vertical direction with respect to the first support.

An outboard motor movement mechanism according to a preferred embodiment of the present invention includes the second support that rotatably supports the outboard motor body, the linkage that couples the first support and the second support to each other such that the second support is movable in the vertical direction and rotatable with respect to the first support, and the first drive that rotates the second support coupled to the first support through the linkage with respect to the first support while moving the second support in the vertical direction with respect to the first support. Thus, the first drive is driven such that the position of the outboard motor body in the vertical direction is adjusted simultaneously while the angle (trim angle) of the outboard motor body supported by the second support is adjusted. Consequently, it is not necessary to separately manipulate the angle of the outboard motor body and the position of the outboard motor body in the vertical direction when the boat is moving, and hence an increase in the operation load to adjust the position and attitude of the outboard motor body when the boat is moving is significantly reduced or prevented. The first drive is driven such that the outboard motor body is rotated and moved in the vertical direction, and hence the structure of the outboard motor movement mechanism is simplified as compared with the case where a mechanism that rotates the outboard motor body and a mechanism that moves the outboard motor body in the vertical direction are provided separately.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of a boat 10 including an outboard motor 100 according to a preferred embodiment of the present invention is now described with reference to FIG. 1. In the figures, arrow FWD represents the forward movement direction of the boat 10, and arrow BWD represents the backward movement direction of the boat 10. In the figures, arrow R represents the starboard direction of the boat 10, and arrow L represents the portside direction of the boat 10.

Figure 1:
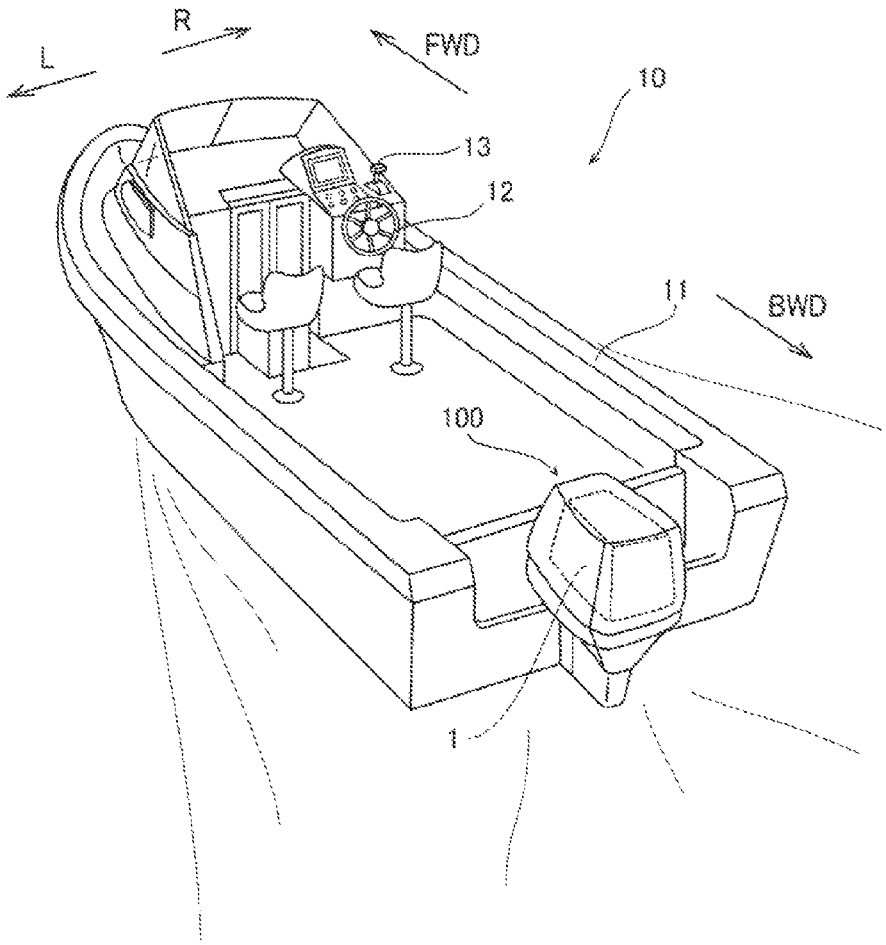
FIG. 1 is a diagram schematically showing a boat including an outboard motor according to a preferred embodiment of the present invention.

The boat 10 includes a boat body 11, a steering wheel 12, and a remote controller 13, as shown in FIG. 1. The outboard motor 100 is mounted on the boat 10.

The steering wheel 12 steers the boat body 11 (turns the outboard motor 100). Specifically, the steering wheel 12 is connected to a steering device of the outboard motor 100. The steering device rotates the outboard motor 100 in a horizontal direction based on an operation of the steering wheel 12.

The remote controller 13 manipulates the shift and output (the position of the throttle) of the outboard motor 100. Specifically, the remote controller 13 is connected to the outboard motor 100. The output and shift (forward movement, reverse movement, or neutral) of an engine 1 of the outboard motor 100 are controlled based on the operation of the remote controller 13.

Figure 2:
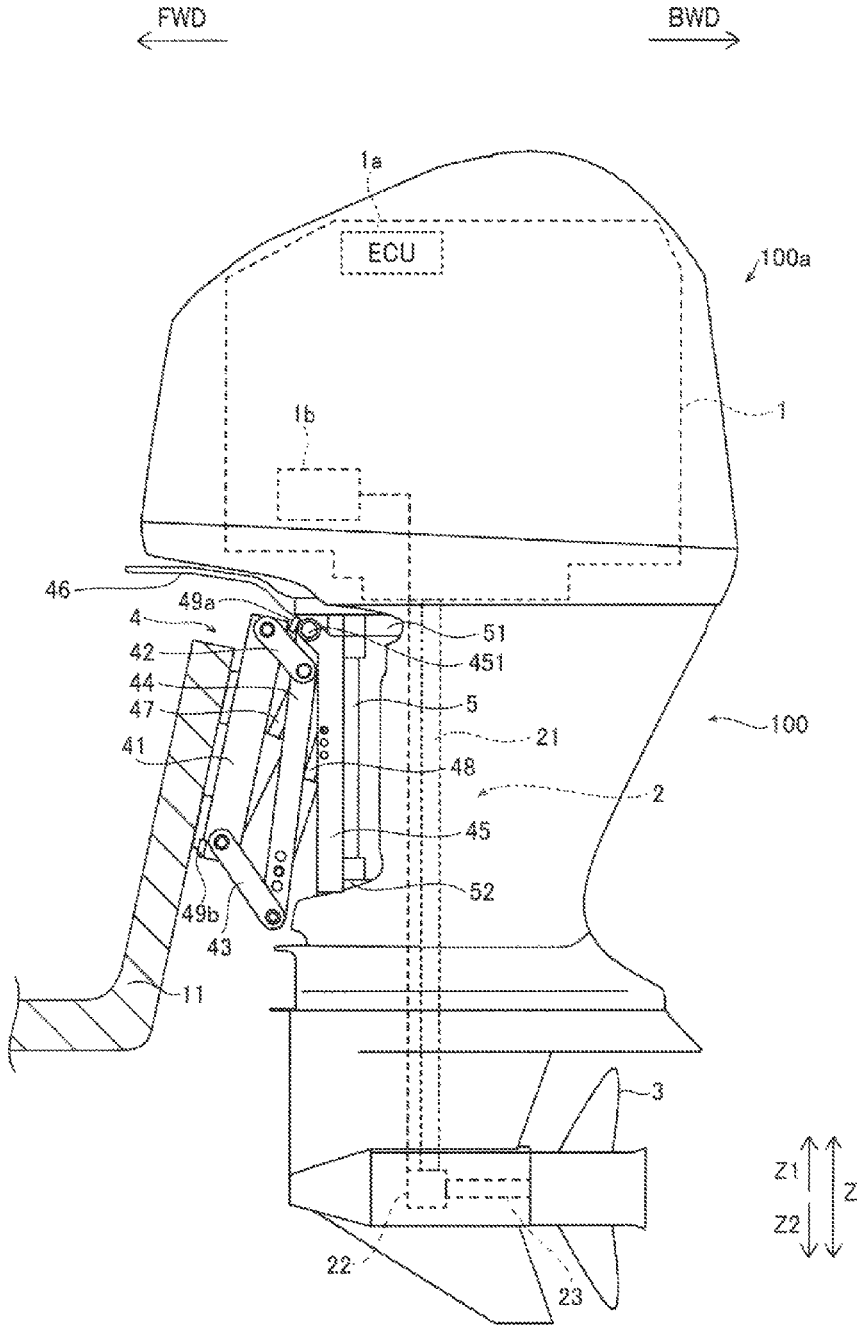
FIG. 2 is a side elevational view schematically showing an outboard motor according to a preferred embodiment of the present invention.

The outboard motor 100 is mounted on a rear portion of the boat body 11, as shown in FIG. 1. The outboard motor 100 includes an outboard motor body 100*a*, as shown in FIG. 2. The outboard motor body 100*a* includes the engine 1, an ECU (engine control unit) 1*a*, a shift actuator 1*b*, a power transmission 2, and a propeller 3. The outboard motor 100 includes an outboard motor movement mechanism 4 and a steering shaft 5. The outboard motor body 100*a* is mounted on the boat body 11 to be rotatable about a vertical (direction Z) axis and a horizontal axis by the outboard motor movement mechanism 4. The outboard motor body 100*a* is mounted on the boat body 11 to be movable in a vertical direction by the outboard motor movement mechanism 4. The ECU 1*a* is one example of the "movement restrictor."

The power transmission 2 includes a drive shaft 21, a gearing 22, and a propeller shaft 23. The outboard motor movement mechanism 4 includes first supports 41, a pair of first couplers 42, a pair of second couplers 43, a pair of second supports 44, a pair of brackets 45, a steering device mount 46, a first drive 47, a second drive 48, and detectors 49*a* and 49*b*. The steering shaft 5 is connected with mounts 51 and 52. The first couplers 42 and the second couplers 43 are examples of a "linkage." The detectors 49*a* and 49*b* are also examples of a "movement restrictor."

The engine 1 is provided in an upper portion of the outboard motor 100, and includes an internal combustion engine driven by explosive combustion of gasoline, light oil, or the like. The engine 1 is covered by an engine cover.

The ECU 1*a* controls the outboard motor 100. Specifically, the ECU 1*a* controls the output (rotational speed) of the engine 1. The ECU 1*a* controls the driving of the outboard motor movement mechanism 4.

The shift actuator 1*b* switches the shift state of the outboard motor 100 based on the user's operation. Specifically, the shift actuator 1*b* changes the shift position to any of forward movement, reverse movement, and neutral. More specifically, the shift actuator 1*b* changes the meshing of the gearing 22 and changes the shift state.

The drive shaft 21 of the power transmission 2 is coupled to a crankshaft of the engine 1 so as to transmit the power of the engine 1. The drive shaft 21 extends in the vertical direction (direction Z).

The gearing 22 of the power transmission 2 is arranged in a lower portion of the outboard motor 100. The gearing 22 decreases the rotational speed of the drive shaft 21 and transmits the decreased rotational speed to the propeller shaft 23. In other words, the gearing 22 transmits the drive force of the drive shaft 21 that rotates about a rotation axis extending in the vertical direction to the propeller shaft 23 that rotates about a rotation axis extending in a front to back direction. Specifically, the gearing 22 includes a pinion gear, a forward movement bevel gear, a reverse movement bevel gear, and a dog clutch. The pinion gear is mounted on a lower end of the drive shaft 21. The forward movement bevel gear and the reverse movement bevel gear are provided on the propeller shaft 23 to hold the pinion gear therebetween. The pinion gear meshes with the forward movement bevel gear and the reverse movement bevel gear. The gearing 22 switches between a state where the dog clutch that rotates integrally with the propeller shaft 23 engages with the forward movement bevel gear and a state where the dog clutch engages with the reverse movement bevel gear so as to switch the shift position (the rotation direction (the forward movement direction and the reverse movement direction) of the propeller shaft 23). The gearing 22 switches to a state where the dog clutch engages with neither the forward movement bevel gear nor the reverse movement bevel gear so as to change the shift position to neutral.

The propeller 3 (screw) is connected to the propeller shaft 23. The propeller 3 is driven to rotate about the rotation axis extending in the front to back direction. The propeller 3 rotates in water to generate thrust force in an axial direction. The propeller 3 moves the boat body 11 forward or reversely according to the rotation direction.

Figure 3:
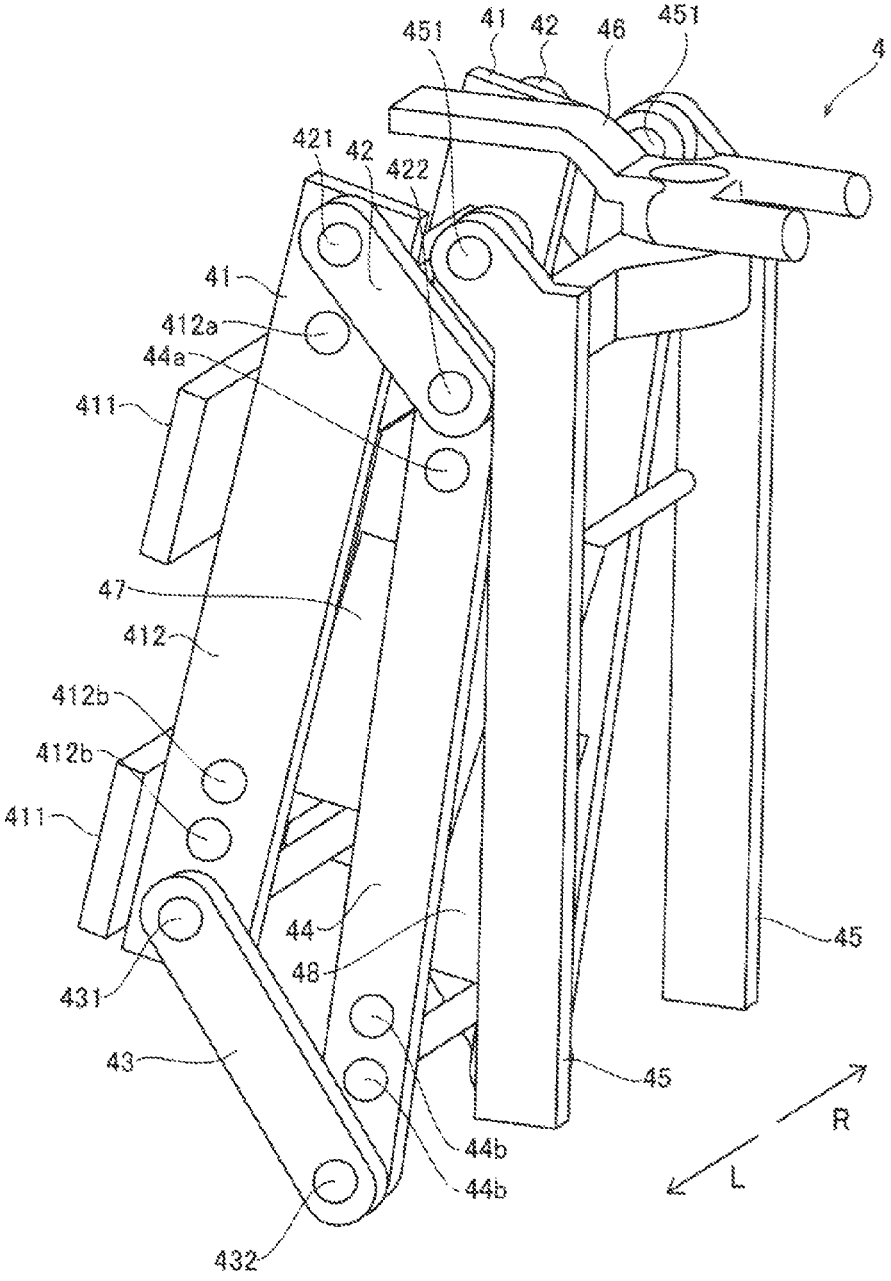
FIG. 3 is a perspective view showing an outboard motor movement mechanism of an outboard motor according to a preferred embodiment of the present invention.

The first supports 41 of the outboard motor movement mechanism 4 are mounted on the boat body 11. The first supports 41 include a pair of boat body mounts 411 and a pair of supports 412, as shown in FIG. 3. The pair of boat body mounts 411 are aligned in the vertical direction. The boat body mounts 411 preferably are each plate-shaped or substantially plate-shaped and extend in a right to left direction. The pair of boat body mounts 411 are fixed to the boat body 11. The pair of supports 412 are aligned in the right to left direction. The supports 412 preferably are each plate-shaped or substantially plate-shaped and extend in the vertical direction. The pair of supports 412 are fixed to the pair of boat body mounts 411. The supports 412 include a plurality of holes 412*a* to mount the first couplers 42. The plurality of holes 412*a* are arranged along the vertical direction. The supports 412 include a plurality of holes 412*b* to mount the second couplers 43. The plurality of holes 412*b* are arranged along the vertical direction.

The first couplers 42 couple the first supports 41 and the second supports 44 to each other. Specifically, the first couplers 42 couple upper portions of the first supports 41 and upper portions of the second supports 44 to each other. The pair of first couplers 42 are arranged along the right to left direction. In other words, a left first coupler 42 couples a left first support 41 and a left second support 44 to each other. A right first coupler 42 couples a right first support 41 and a right second support 44 to each other. The first couplers 42 are rotatably coupled to the first supports 41 through rotation shafts 421. The first couplers 42 are rotatably coupled to the second supports 44 through rotation shafts 422.

The second couplers 43 couple the first supports 41 and the second supports 44 to each other. Specifically, the second couplers 43 couple lower portions of the first supports 41 and lower portions of the second supports 44 to each other. The pair of second couplers 43 are arranged along the right to left direction. In other words, a left second coupler 43 couples a left first support 41 and a left second support 44 to each other. A right second coupler 43 couples a right first support 41 and a right second support 44 to each other. The second couplers 43 are rotatably coupled to the first supports 41 through rotation shafts 431. The second couplers 43 are rotatably coupled to the second supports 44 through rotation shafts 432.

The second supports 44 rotatably support the outboard motor body 100*a*. Specifically, the second supports 44 support the outboard motor body 100*a* such that the outboard motor body 100*a* is rotatable about a rotation axis extending in the right to left direction. In other words, the second supports 44 include rotation shafts 451 that support the outboard motor body 100*a* rotatably with respect to the second supports 44. The pair of second supports 44 are arranged along the right to left direction. The second supports 44 preferably are each plate-shaped or substantially plate-shaped and extend in the vertical direction. The second supports 44 include a plurality of holes 44*a* to mount the first couplers 42. The plurality of holes 44*a* are arranged along the vertical direction. The second supports 44 include a plurality of holes 44*b* to mount the second couplers 43. The plurality of holes 44*b* are arranged along the vertical direction.

Figure 6:
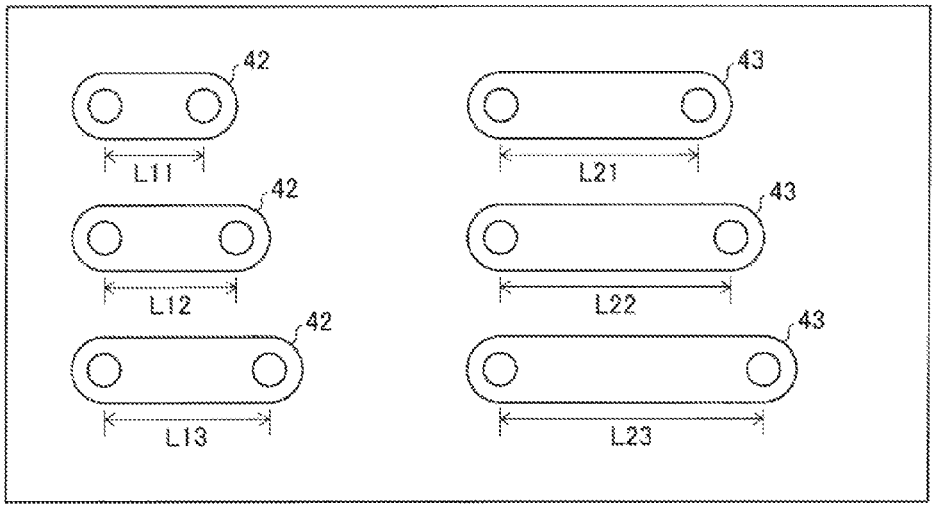
FIG. 6 is a diagram showing couplers of an outboard motor according to a preferred embodiment of the present invention.

According to a preferred embodiment of the present invention, the first supports 41 and the second supports 44 are rotatably coupled to each other by the first couplers 42 and the second couplers 43. Thus, the linkage couples the first supports 41 and the second supports 44 to each other such that the second supports 44 are movable in the vertical direction and rotatable with respect to the first supports 41. As shown in FIG. 6, coupling distances that are the lengths of the first couplers 42 between the first supports 41 and the second supports 44 are shorter than coupling distances that are lengths of the second couplers 43 between the first supports 41 and the second supports 44. The coupling distances of the first couplers 42 and the coupling distances of the second couplers 43 are adjustable. The first couplers 42 and the second couplers 43 are selected from among a plurality of couplers having lengths different from each other, for example. The first couplers 42 are selected from among couplers having coupling distances of, for example, L11, L12, and L13, which are different from each other. L11 is less than L12, and L12 is less than L13. The second couplers 43 are selected from among couplers having coupling distances of, for example, L21, L22, and L23, which are different from each other. L21 is less than L22, and L22 is less than L23. The first couplers 42 and the second couplers 43 may be selected from among three or more couplers having different coupling distances.

As shown in FIG. 3, each of the first couplers 42 is coupled to one hole 412*a* selected from among the plurality of holes 412*a* of the first supports 41. Each of the first couplers 42 is coupled to one hole 44*a* selected from among the plurality of holes 44*a* of the second supports 44. Each of the second couplers 43 is coupled to one hole 412*b* selected from among the plurality of holes 412*b* of the first supports 41. Each of the second couplers 43 is coupled to one hole 44*b* selected from among the plurality of holes 44*b* of the second supports 44. Thus, the length of the linkage is adjusted.

The brackets 45 are supported by the second supports 44 through the rotation shafts 451. The brackets 45 support the outboard motor body 100*a* through the steering shaft 5 and the mounts 51 and 52, as shown in FIG. 2. In other words, the brackets 45 are rotated with respect to the second supports 44 about the rotation shafts 451 that extend in the right to left direction. The brackets 45 support the outboard motor body 100*a* such that the outboard motor body 100*a* is steerable about the steering shaft 5 that extends in the vertical direction. The pair of brackets 45 are arranged along the right to left direction. The brackets 45 preferably are plate-shaped or substantially plate-shaped and extend in the vertical direction.

The steering device is mounted on a front portion of the steering device mount 46, and the outboard motor body 100*a* is mounted on a rear portion of the steering device mount 46. The steering device mount 46 is moved from side to side by the steering device such that the outboard motor body 100*a* is rotated about the steering shaft 5.

Figure 4:
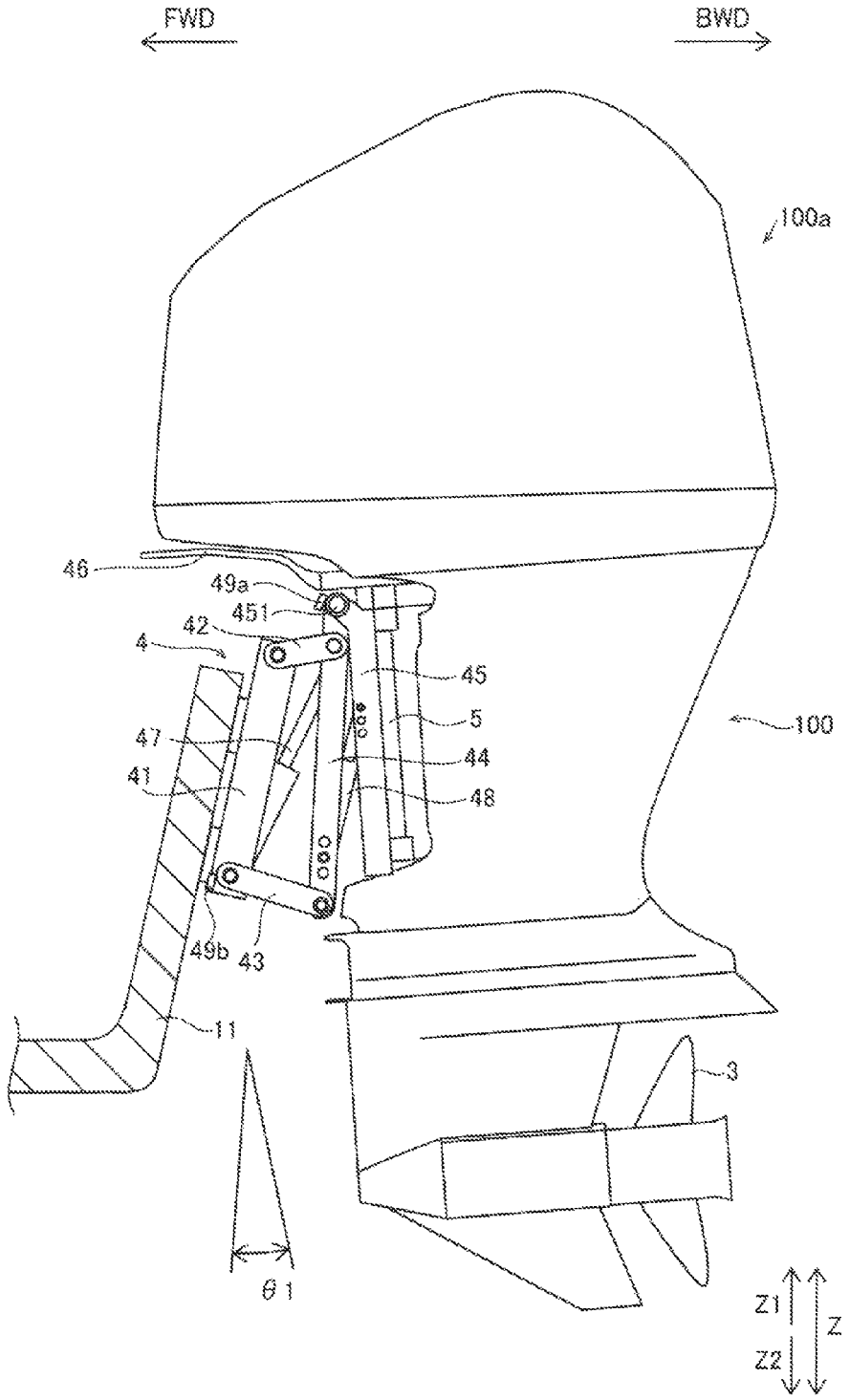
FIG. 4 is a side elevational view for illustrating trim angle adjustment of an outboard motor according to a preferred embodiment of the present invention.

According to a preferred embodiment of the present invention, the first drive 47 rotates the second supports 44 coupled to the first supports 41 through the first couplers 42 and the second couplers 43 with respect to the first supports 41 while moving the second supports 44 in the vertical direction (direction Z) with respect to the first supports 41, as shown in FIG. 4. In other words, the first drive 47 adjusts the trim angle and vertical position of the outboard motor body 100*a*. The trim angle is changed to adjust the direction and vertical position of the propeller 3 of the outboard motor body 100*a* when the boat 10 is moving. The first drive 47 moves the rotation shafts 451 together with the second supports 44 with respect to the first supports 41. The first drive 47 moves the rotation centers of the second supports 44 with respect to the first supports 41 while moving the second supports 44 in the vertical direction with respect to the first supports 41.

As shown in FIG. 4, the first drive 47 rotates the second supports 44 with respect to the first supports 41 within a range of an angle θ1. In other words, the first drive 47 adjusts the trim angle of the outboard motor body 100*a* within the range of the angle θ1. The angle θ1 is an example of the "first angle". A first end of the first drive 47 is rotatably connected to lower portions of the first supports 41. A second end of the first drive 47 is rotatably connected to upper portions of the second supports 44. The first drive 47 is expandable and contractible. For example, the first drive 47 includes a hydraulic cylinder that is hydraulically extended and retracted. The first drive 47 contracts to rotate the outboard motor body 100*a* clockwise when the outboard motor 100 is viewed from the left and move the outboard motor body 100*a* downward (along arrow Z2). The first drive 47 expands to rotate the outboard motor body 100*a* counterclockwise when the outboard motor 100 is viewed from the left and move the outboard motor body 100*a* upward (along arrow Z1).

Figure 5:
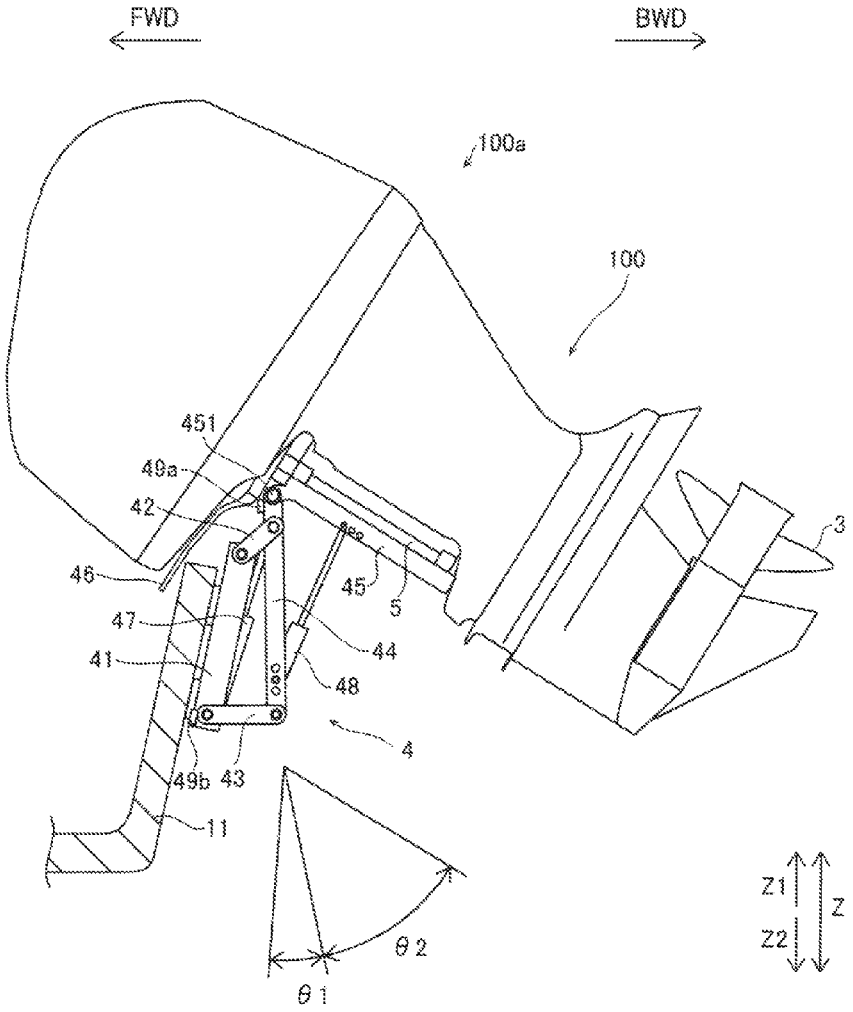
FIG. 5 is a side elevational view for illustrating tilt angle adjustment of an outboard motor according to a preferred embodiment of the present invention.

According to a preferred embodiment of the present invention, the second drive 48 rotates the outboard motor body 100*a* with respect to the second supports 44, as shown in FIG. 5. In other words, the second drive 48 adjusts the tilt angle of the outboard motor body 100*a*. The tilt angle is changed to lift the outboard motor body 100*a* upward with respect to the boat body 11 when the boat 10 is stored.

As shown in FIG. 5, the second drive 48 rotates the outboard motor body 100*a* with respect to the second supports 44 within a range of an angle θ2. The angle θ2 is larger than the angle θ1. In other words, the second drive 48 adjusts the tilt angle of the outboard motor body 100*a* within the range of the angle θ2. The angle θ2 is an example of the "second angle". A first end of the second drive 48 is rotatably connected to lower portions of the second supports 44. A second end of the second drive 48 is rotatably connected to the brackets 45. The second drive 48 is expandable and contractible. For example, the second drive 48 includes a hydraulic cylinder that is hydraulically extended and retracted. The second drive 48 contracts to rotate the outboard motor body 100*a* clockwise when the outboard motor 100 is viewed from the left and reduce the tilt angle of the outboard motor body 100*a*. The second drive 48 expands to rotate the outboard motor body 100*a* counterclockwise when the outboard motor 100 is viewed from the left and increase the tilt angle of the outboard motor body 100*a*.

The rotation shafts 451 are arranged above the upper ends of the first supports 41 when the outboard motor body 100*a* is rotated with respect to the second supports 44. The rotation shafts 451 are kept stationary with respect to the first supports 41 when the outboard motor body 100*a* is rotated with respect to the second supports 44. In other words, the rotation shafts 451 are fixed in a state where the same are moved upward when the tilt angle of the outboard motor body 100*a* is adjusted.

The detectors 49*a* and 49*b* detect the predetermined rotation angle or the predetermined movement of the second supports 44 with respect to the first supports 41. The detectors 49*a* and 49*b* electrically allow the rotation of the outboard motor body 100*a* with respect to the second supports 44 when the rotation angle or the movement of the second supports 44 with respect to the first supports 41 is at least a predetermined value. In other words, the rotation of the outboard motor body 100*a* with respect to the second supports 44 is allowed when the rotation angle or the movement of the second supports 44 with respect to the first supports 41 is at least the predetermined value. Specifically, the detector 49*a* is mounted on at least one of the second supports 44, as shown in FIG. 2, and is switched on or off by the rotation of the brackets 45. The detector 49*b* is mounted on at least one of the first supports 41, and is switched on or off by the rotation of the second couplers 43.

The detector 49*a* is turned on when the outboard motor body 100*a* is moved down to the bottom with respect to the second supports 44. The detector 49*a* is turned off when the outboard motor body 100*a* is moved up with respect to the second supports 44. When the detector 49*a* is turned on, the driving of the first drive 47 is enabled. When the detector 49*a* is turned off, the driving of the first drive 47 is not enabled.

Figure 7:
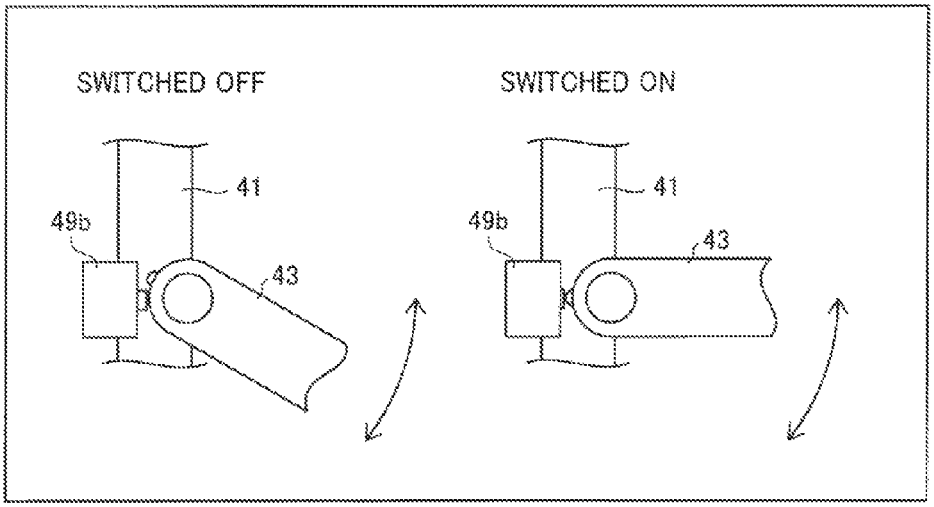
FIG. 7 is a schematic diagram for illustrating a movement restrictor of an outboard motor according to a preferred embodiment of the present invention.

As shown in FIG. 7, the detector 49*b* is turned on when the second supports 44 are moved up to the top with respect to the first supports 41. The detector 49*b* is turned off when the second supports 44 are moved down with respect to the first supports 41. When the detector 49*b* is turned on, the driving of the second drive 48 is enabled. When the detector 49*b* is turned off, the driving of the second drive 48 is not enabled.

The ECU 1*a* prevents the rotation of the outboard motor body 100*a* with respect to the second supports 44. Specifically, the ECU 1*a* allows the rotation of the outboard motor body 100*a* with respect to the second supports 44 when the rotational speed of the engine 1 is not more than a predetermined value. The ECU 1*a* allows the rotation of the outboard motor body 100*a* with respect to the second supports 44 when the rotational speed of the engine 1 is not more than an idle speed, for example. The ECU 1*a* allows the rotation of the outboard motor body 100*a* with respect to the second supports 44 when the gearing 22 is in neutral.

Figure 8:
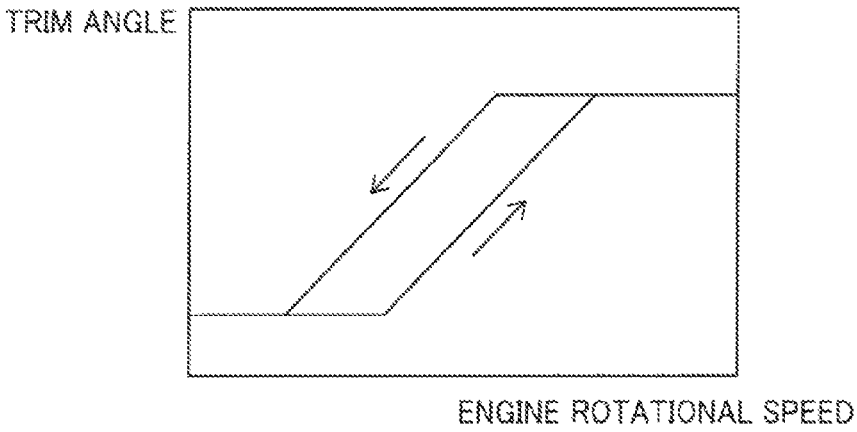
FIG. 8 is a diagram showing a first example of a relationship between the trim angle and engine rotational speed of an outboard motor according to a preferred embodiment of the present invention.

The ECU 1*a* controls the driving of the first drive 47 according to the rotational speed of the engine 1 and adjusts the trim angle and vertical position of the outboard motor body 100*a*. The ECU 1*a* increases the trim angle as the rotational speed of the engine 1 increases, as shown in FIG. 8, for example. A relationship between the trim angle and the engine rotational speed has hysteresis, and the constant driving of the first drive 47 according to a variation in the engine rotational speed is thus significantly reduced or prevented.

Figure 9:
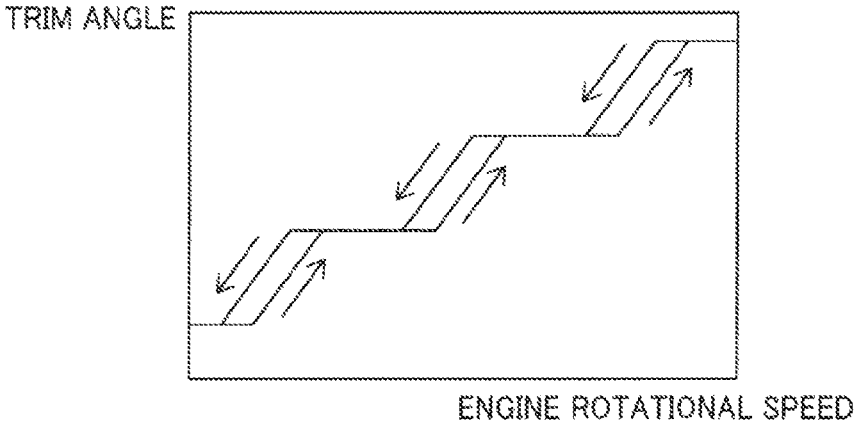
FIG. 9 is a diagram showing a second example of the relationship between the trim angle and engine rotational speed of the outboard motor according to a preferred embodiment of the present invention.

The ECU 1*a* may increase the trim angle with respect to the engine rotational speed in a stepwise manner, as shown in FIG. 9. A relationship between the trim angle and the engine rotational speed has hysteresis, and the constant driving of the first drive 47 according to a variation in the engine rotational speed is thus significantly reduced or prevented.

According to various preferred embodiments of the present invention, the following advantageous effects are obtained.

According to a preferred embodiment of the present invention, the outboard motor 100 includes the second supports 44 that rotatably support the outboard motor body 100*a*, the first couplers 42 and the second couplers 43 that couple the first supports 41 and the second supports 44 to each other such that the second supports 44 are movable in the vertical direction (direction Z) and rotatable with respect to the first supports 41, and the first drive 47 that rotates the second supports 44 coupled to the first supports 41 through the first couplers 42 and the second couplers 43 with respect to the first supports 41 while moving the second supports 44 in the vertical direction with respect to the first supports 41. Thus, the first drive 47 is driven such that the position of the outboard motor body 100*a* in the vertical direction is adjusted simultaneously while the angle (trim angle) of the outboard motor body 100*a* supported by the second supports 44 is adjusted. Consequently, it is not necessary to separately manipulate the angle of the outboard motor body 100*a* and the position of the outboard motor body 100*a* in the vertical direction when the boat 10 is moving, and hence an increase in the operation load to adjust the position and attitude of the outboard motor body 100*a* when the boat 10 is moving is significantly reduced or prevented. The first drive 47 is driven such that the outboard motor body 100*a* is rotated and moved in the vertical direction, and hence the structure of the outboard motor 100 is simplified as compared with the case where a mechanism that rotates the outboard motor body 100*a* and a mechanism that moves the outboard motor body 100*a* in the vertical direction are provided separately. Furthermore, the outboard motor 100 includes the second drive 48 that rotates the outboard motor body 100*a* with respect to the second supports 44 such that the outboard motor body 100*a*, which has been moved in the vertical direction and rotated by the first drive 47, is further rotated by the second drive 48, and the tilt angle is adjusted. Thus, the outboard motor body 100*a* is easily moved to an attitude to be assumed when the boat is stored. The outboard motor body 100*a* is moved and rotated by the first drive 47, and hence the driving range of the second drive 48 is reduced. Thus, an increase in the size of the second drive 48 is significantly reduced or prevented.

According to a preferred embodiment of the present invention, the outboard motor 100 includes the first couplers 42 that couple the upper portions of the first supports 41 and the upper portions of the second supports 44 to each other and the second couplers 43 that couple the lower portions of the first supports 41 and the lower portions of the second supports 44 to each other as the linkage. Thus, the first supports 41 and the second supports 44 are coupled to each other by the first couplers 42 and the second couplers 43 that are vertically spaced apart from each other, and hence the second supports 44 are moved with respect to the first supports 41 by the first drive 47 such that the angle of the outboard motor body 100*a* is easily changed, and the vertical position of the outboard motor body 100*a* is moved.

According to a preferred embodiment of the present invention, the coupling distances that are the lengths of the first couplers 42 between the first supports 41 and the second supports 44 are shorter than the coupling distances that are the lengths of the second couplers 43 between the first supports 41 and the second supports 44. Thus, the lower coupling distances are longer than the upper coupling distances, and hence the outboard motor body 100*a* is moved upward while the angle of the outboard motor body 100*a* is changed.

According to a preferred embodiment of the present invention, the coupling distances of the first couplers 42 and the coupling distances of the second couplers 43 are adjustable. Thus, the distance that the outboard motor body 100*a* moves in the vertical direction associated with the rotation of the outboard motor body 100*a* is adjustable, and hence the linkage is adjusted such that the outboard motor body 100*a* assumes an appropriate attitude according to the output of the outboard motor 100 and the size of the boat body 11.

According to a preferred embodiment of the present invention, the first drive 47 moves the rotation shafts 451 together with the second supports 44 with respect to the first supports 41. Thus, the rotation shafts 451 are moved upward when the second supports 44 are moved upward and rotated by the first drive 47, and hence the rotation angle of the outboard motor body 100*a* with respect to the second supports 44 is reduced. Consequently, the projection of the upper portion of the outboard motor body 100*a* toward the boat body 11 is reduced when the outboard motor body 100*a* is rotated upward.

According to a preferred embodiment of the present invention, the rotation shafts 451 are arranged above the upper ends of the first supports 41 when the outboard motor body 100*a* is rotated with respect to the second supports 44. Thus, the rotation angle of the outboard motor body 100*a* with respect to the second supports 44 is further reduced when the outboard motor body 100*a* is rotated upward.

According to a preferred embodiment of the present invention, the rotation shafts 451 are kept stationary with respect to the first supports 41 when the outboard motor body 100*a* is rotated with respect to the second supports 44. Thus, the outboard motor body 100*a* is rotated with respect to the second supports 44 in a state where the rotation shafts 451 are fixed, and hence the outboard motor body 100*a* is rotated in a stable manner.

According to a preferred embodiment of the present invention, the first drive 47 moves the rotation centers of the second supports 44 with respect to the first supports 41 while moving the second supports 44 in the vertical direction with respect to the first supports 41. Thus, the position of the outboard motor body 100*a* in the vertical direction and the rotation angle of the outboard motor body 100*a* are easily changed simultaneously.

According to a preferred embodiment of the present invention, the first drive 47 rotates the second supports 44 with respect to the first supports 41 within the range of the angle θ1. Furthermore, the second drive 48 rotates the outboard motor body 100*a* with respect to the second supports 44 within the range of the angle θ2 that is larger than the angle θ1. Thus, the angle (trim angle) of the outboard motor body 100*a* and the position of the outboard motor body 100*a* in the vertical direction are adjusted by the first drive 47 when the boat 10 is moving, and the angle (tilt angle) of the outboard motor body 100*a* is adjusted by the second drive 48 when the boat 10 is stored.

According to a preferred embodiment of the present invention, the outboard motor 100 is provided with the ECU 1*a* and the detectors 49*a* and 49*b* that restrict the rotation of the outboard motor body 100*a* with respect to the second supports 44. Thus, the rotation of the outboard motor body 100*a* with respect to the second supports 44 is prevented when the second supports 44 are moved with respect to the first supports 41, and hence complicated movement of the outboard motor body 100*a* is significantly reduced or prevented. Furthermore, the simultaneous driving of the first drive 47 and the second drive 48 is significantly reduced or prevented, and hence an increase in the total load resulting from duplication of the driving load is significantly reduced or prevented.

According to a preferred embodiment of the present invention, the ECU 1*a* allows the rotation of the outboard motor body 100*a* with respect to the second supports 44 when the rotation angle or the movement of the second supports 44 with respect to the first supports 41 is at least the predetermined value. Thus, the outboard motor body 100*a* is moved with respect to the second supports 44 in a state where the second supports 44 are moved with respect to the first supports 41, and hence the rotation angle of the outboard motor body 100*a* with respect to the second supports 44 is easily reduced.

According to a preferred embodiment of the present invention, the detectors 49*a* and 49*b* that detect the predetermined rotation angle or the predetermined movement of the second supports 44 with respect to the first supports 41 electrically allow the rotation of the outboard motor body 100*a* with respect to the second supports 44 when the rotation angle or the movement of the second supports 44 with respect to the first supports 41 is at least the predetermined value. Thus, the predetermined rotation angle or the predetermined movement of the second supports 44 with respect to the first supports 41 is detected by the detectors 49*a* and 49*b* such that the rotation of the outboard motor body 100*a* with respect to the second supports 44 is easily prevented.

According to a preferred embodiment of the present invention, the ECU 1*a* allows the rotation of the outboard motor body 100*a* with respect to the second supports 44 when the rotational speed of the engine 1 is not more than the predetermined value. Thus, the possibility that the outboard motor body 100*a* comes out of the water is significantly reduced or prevented when the engine 1 is driven at a high rotational speed.

According to a preferred embodiment of the present invention, the ECU 1*a* allows the rotation of the outboard motor body 100*a* with respect to the second supports 44 when the gearing 22 is in neutral. Thus, the possibility that the outboard motor body 100*a* comes out of the water is significantly reduced or prevented when the propeller 3 is rotated.

The preferred embodiments of the present invention described above are illustrative in all points and not restrictive. The extent of the present invention is not defined by the above description of the preferred embodiments but by the scope of claims, and all modifications within the meaning and range equivalent to the scope of claims are further included.

For example, while a single outboard motor is preferably provided in a boat according to a preferred embodiment described above, the present invention is not restricted to this. According to a preferred embodiment of the present invention, a plurality of outboard motors may be provided on the boat.

Figure 10:
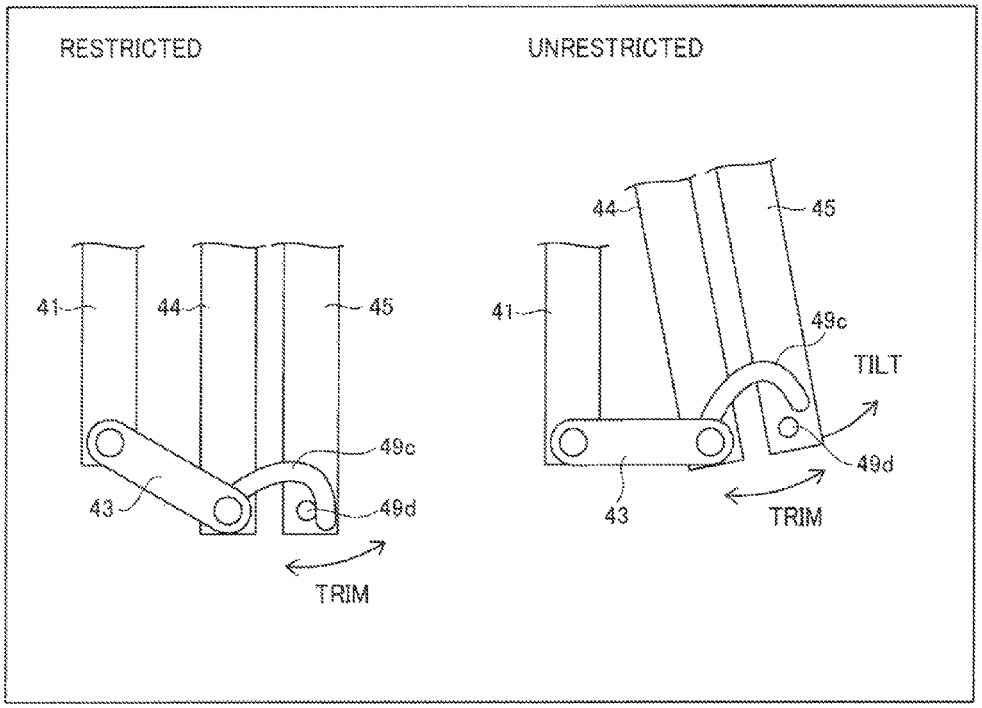
FIG. 10 is a schematic diagram for illustrating a movement restrictor of an outboard motor according to a modified preferred embodiment of the present invention.

While the predetermined angle or the predetermined movement of the second supports with respect to the first supports is preferably detected by the detectors such that the rotation of the outboard motor body with respect to the second supports is prevented in a preferred embodiment described above, the present invention is not restricted to this. According to a preferred embodiment of the present invention, the movement restrictor may alternatively include engagement portions that engage with the linkage or the outboard motor body, prevent the rotation of the outboard motor body with respect to the second supports by engagement of the engagement portions with the linkage or the outboard motor body, and allow the rotation of the outboard motor body with respect to the second supports by disengagement of the engagement portions when the rotation angle or the movement of the second supports with respect to the first supports is at least the predetermined value. As in a modified preferred embodiment of the present invention shown in FIG. 10, for example, engagement portions 49*c* may be provided on second couplers 43, and engagement portions 49*d* that engage with the engagement portions 49*c* may be provided on brackets 45. In this case, the second supports 44 may be rotated with respect to first supports 41 and moved by a predetermined angle or a predetermined movement such that the engagement portions 49*c* and 49*d* disengage from each other.

While the first couplers preferably have lengths different from each other and the second couplers preferably have lengths different from each other, and the coupling distances of the first couplers and the coupling distances of the second couplers are preferably adjusted in a preferred embodiment described above, the present invention is not restricted to this. According to a preferred embodiment of the present invention, the first couplers and the second couplers may alternatively be screw-in expandable and contractible members, and the coupling distances thereof may be adjusted. Furthermore, the first couplers and the second couplers may alternatively be slidable and include a plurality of fixation holes, and the coupling distances thereof may be adjusted by selecting the fixation holes.

While the outboard motor preferably includes the outboard motor movement mechanism in advance according to a preferred embodiment described above, the present invention is not restricted to this. According to a preferred embodiment of the present invention, the outboard motor movement mechanism may alternatively be mounted on an existing outboard motor. In this case, the second drive may be provided in the outboard motor.

While the first drive and the second drive are preferably hydraulically driven in a preferred embodiment described above, the present invention is not restricted to this. According to a preferred embodiment of the present invention, the first drive and the second drive may be driven other than hydraulically. The first drive and the second drive may be electrically driven, for example.

While the outboard motor is preferably driven by the engine in a preferred embodiment described above, the present invention is not restricted to this. According to a preferred embodiment of the present invention, the outboard motor may alternatively be driven by a motor or by both the engine and the motor.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an outboard motor body;

a first support mounted on a boat body;

a second support that rotatably supports the outboard motor body;

a linkage that couples the first support and the second support to each other such that the second support is movable in a vertical direction and rotatable with respect to the first support;

a first drive that rotates the second support coupled to the first support through the linkage with respect to the first support while moving the second support in the vertical direction with respect to the first support; and a second drive that rotates the outboard motor body with respect to the second support; wherein the linkage includes a first coupler that couples an upper portion of the first support and an upper portion of the second support to each other and a second coupler that couples a lower portion of the first support and a lower portion of the second support to each other.

2. The outboard motor according to claim 1, wherein a coupling distance that is a length of the first coupler between the first support and the second support is shorter than a coupling distance that is a length of the second coupler between the first support and the second support.

3. The outboard motor according to claim 2, wherein the coupling distance of the first coupler and the coupling distance of the second coupler are adjustable.

4. The outboard motor according to claim 1, further comprising a rotation shaft that supports the outboard motor body such that the outboard motor body is rotatable with respect to the second support; wherein the first drive moves the rotation shaft together with the second support with respect to the first support.

5. The outboard motor according to claim 4, wherein the rotation shaft is arranged above an upper end of the first support when the outboard motor body is rotated with respect to the second support.

6. The outboard motor according to claim 4, wherein the rotation shaft is kept stationary with respect to the first support when the outboard motor body is rotated with respect to the second support.

7. The outboard motor according to claim 1, wherein the first drive moves a rotation center of the second support with respect to the first support while moving the second support in the vertical direction with respect to the first support.

8. The outboard motor according to claim 1, wherein the first drive rotates the second support with respect to the first support within a range of a first angle; and the second drive rotates the outboard motor body with respect to the second support within a range of a second angle that is larger than the first angle.

9. An outboard motor comprising:

an outboard motor body;

a first support mounted on a boat body;

a second support that rotatably supports the outboard motor body;

a linkage that couples the first support and the second support to each other such that the second support is movable in a vertical direction and rotatable with respect to the first support;

a first drive that rotates the second support coupled to the first support through the linkage with respect to the first support while moving the second support in the vertical direction with respect to the first support;

a second drive that rotates the outboard motor body with respect to the second support; and a movement restrictor that prevents rotation of the outboard motor body with respect to the second support.

10. The outboard motor according to claim 9, wherein the movement restrictor allows the rotation of the outboard motor body with respect to the second support when a rotation angle or a movement of the second support with respect to the first support is at least a predetermined value.

11. The outboard motor according to claim 10, wherein the movement restrictor includes an engagement portion that engages with the linkage or the outboard motor body, prevents the rotation of the outboard motor body with respect to the second support by engagement of the engagement portion with the linkage or the outboard motor body, and allows the rotation of the outboard motor body with respect to the second support by disengagement of the engagement portion when the rotation angle or the movement of the second support with respect to the first support is at least the predetermined value.

12. The outboard motor according to claim 9, wherein the movement restrictor includes a detector that detects a predetermined rotation angle or a predetermined movement of the second support with respect to the first support, and electrically allows the rotation of the outboard motor body with respect to the second support when the rotation angle or the movement of the second support with respect to the first support is at least a predetermined value.

13. The outboard motor according to claim 9, wherein the outboard motor body includes an engine; and the movement restrictor allows the rotation of the outboard motor body with respect to the second support when a rotational speed of the engine is not more than a predetermined value.

14. The outboard motor according to claim 9, wherein the outboard motor body includes an engine and a gearing that switches a drive force of the engine to forward movement, reverse movement, and neutral; and the movement restrictor allows the rotation of the outboard motor body with respect to the second support when the gearing is in neutral.

15. An outboard motor movement mechanism comprising:

a first support mounted on a boat body;

a second support that rotatably supports an outboard motor body;

a linkage that couples the first support and the second support to each other such that the second support is movable in a vertical direction and rotatable with respect to the first support; and a first drive that rotates the second support coupled to the first support through the linkage with respect to the first support while moving the second support in the vertical direction with respect to the first support; wherein the linkage includes a first coupler that couples an upper portion of the first support and an upper portion of the second support to each other and a second coupler that couples a lower portion of the first support and a lower portion of the second support to each other.

* * * * *